US006364164B1

(12) United States Patent
Troiano

(10) Patent No.: US 6,364,164 B1
(45) Date of Patent: Apr. 2, 2002

(54) DEVICE FOR OPENING PACKAGES OF POURABLE FOOD PRODUCTS

(75) Inventor: Antonio Troiano, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/601,744

(22) PCT Filed: Mar. 31, 1999

(86) PCT No.: PCT/EP99/02215

§ 371 Date: Aug. 7, 2000

§ 102(e) Date: Aug. 7, 2000

(87) PCT Pub. No.: WO99/51502

PCT Pub. Date: Oct. 14, 1999

(30) Foreign Application Priority Data

Apr. 3, 1998 (EP) ..... 98106164

(51) Int. Cl.[7] ..... B67D 5/00

(52) U.S. Cl. ..... 222/83; 222/556; 220/278; 220/297

(58) Field of Search ..... 222/562, 556, 222/568, 83, 89, 91; 220/258, 277, 278, 297

(56) References Cited

U.S. PATENT DOCUMENTS

| | | | | |
|---|---|---|---|---|
| 4,655,387 A | | 4/1987 | Magnusson | |
| 5,141,133 A | | 8/1992 | Ninomiya et al. | |
| 5,564,622 A | | 10/1996 | Wald | |
| 5,853,109 A | * | 12/1998 | Elliot | 222/83 |
| 5,947,318 A | * | 9/1999 | Palm | 220/297 |
| 6,223,924 B1 | * | 5/2001 | Ek et al. | 220/278 |

FOREIGN PATENT DOCUMENTS

| | | |
|---|---|---|
| DE | 296 19 195 | 4/1997 |
| EP | 0 108 444 | 5/1984 |
| EP | 0 328 652 | 8/1989 |
| EP | 0 558 946 | 9/1993 |
| EP | 0 658 480 | 6/1995 |
| EP | 0 770 555 | 5/1997 |
| JP | 63-149818 | 10/1988 |
| JP | 63-156928 | 10/1988 |
| JP | 64-2727 | 1/1989 |
| WO | 96/11850 | 4/1996 |

* cited by examiner

*Primary Examiner*—Philippe Derakshani
(74) *Attorney, Agent, or Firm*—Burns, Doane, Swecker & Mathis, L.L.P.

(57) ABSTRACT

The device has a frame fixable on a package, a tubular member connected to the frame and internally defining a pouring opening, and a cap connected by an elastic hinge to the tubular member for rotation about a first axis for opening and closing the pouring opening. The tubular member is movably connected to the frame for rotation about a second axis extending perpendicularly with respect to the first axis. A lug connected to the cap slidably engages a protrusion connected to the frame for preventing rotation of the tubular member about the second axis, until completion of a predetermined angular displacement of the tubular member with respect to said frame.

9 Claims, 9 Drawing Sheets

DEVICE FOR OPENING PACKAGES OF POURABLE FOOD PRODUCTS

TECHNICAL FIELD

The present invention relates to a device for opening sealed packages of pourable food product. The device is especially useful for opening sealed aseptic cartons of the type commonly used for packaging a wide range of food products including wine, tea, tomato puree, fruit juice, mineral water, yogurt, cream, and thermally treated milk, i.e., milk treated at ultra-high temperature, commonly known as UHT milk. Typical examples of such packages are the parallelepiped-shaped packages known by the registered trademarks Tetra Brik® and Tetra Brik Aseptic®, and the parallelepiped packages with bevelled corners, known by the registered trademarks Tetra Prisma® and Tetra Prisma Aseptic®, which are manufactured using machines for packaging pourable food products such as the TBA/21™ filling machine, available from Tetra Brik Packaging Systems, Via Delfini, Modena, Italy.

BACKGROUND ART

Various solutions have been proposed for permitting a user to conveniently open the above-mentioned type of package and access the products contained therein in a convenient manner.

According to one prior solution known from U.S. Pat. No. 4,655,387, a perforated line was provided diagonally across the corner flap of a package. By lifting the corner flap and tearing along the perforated line, a user could open the package. This arrangement was simple and permitted an inexpensive means of allowing a user to open and pour contents from a package. However, although the corner flap could be folded to prevent insects or dust entering any product remaining in the carton after a first use, the carton could not be re-closed in a reliable manner and in the event that the carton was tipped over, product spillage was inevitable.

Another prior solution known from European Patent No. 108444, envisages the provision of a pre-punched hole in the packaging material, covered by a tab of material which a user can grip and tear-off, in order to pour the contents through the pre-punched hole. As known, the above-described cartons are made of a laminated material comprising a layer of fibre-based material such as paper having an appropriate degree of stiffness, and covered on both sides with a heat-sealable plastics material. In the case of an aseptic package, an aseptic barrier layer constituted e.g., by an aluminium foil layer, is applied to side of the packaging material which is destined to be located on the inside of the carton. The aseptic barrier layer is, in turn, covered with a layer of food-compatible plastics material. The pre-punched hole extends through the paper and through the heat-sealable plastics material covering the paper. However, the aseptic barrier layer remains intact. The pull-tab is affixed to the aseptic barrier layer in the pre-punched hole. In this way, the aseptic qualities of the package are guaranteed, until such time that a user pulls the tab to tear open the aseptic barrier layer in the pre-punched hole. This arrangement made it very quick and simple to open a package.

Further developments saw the introduction of opening devices such as the ones known from European Patent No. 558946, and from European Patent No. 658,480 having a frame surrounding the pre-punched hole and pull-tab, and a reclosable lid hinged the frame. These known arrangements provide easy opening and permit packages to be reclosed.

Although these opening devices have gained widespread consumer acceptance, they are mainly used on packages having a volume of at least 500 ml, and have been particularly appreciated when used on large-volume packages containing, for example, 1000 ml or 1500 ml of liquid-food product, when it is often desired to serve some of the product, then reclose the package and store the remaining product.

For small volume packages containing a single serving of food product, such as e.g., 200 ml or 330 ml cartons of fruit juice, commonly known as portion packages, the opening arrangements have mainly been in the form of a small, pre-punched straw hole. The consumer simply perforates the aseptic barrier layer in the pre-punched hole with a drinking straw in order to consume the product contained in the carton. Also known from DE-U1-26919195, is a device having a threaded tubular member defining a pouring opening therein and adapted for screwing into the straw hole of a package, and a cap for closing the pouring opening which is connected by a flexible hinge to the tubular member. A user simply screws the tubular member into the straw hole and opens the cap in order to allow product to flow through the pouring opening. However, these solutions imply providing and individually packaging drinking straws or opening devices, and either applying a suitably packed drinking straw to the outside of every carton, or purchasing the opening device for screwing into the straw hole of the cartons separately. Although the use of individually packed drinking straws attached to each carton has found wide consensus among consumers, especially children, it does not allow direct drinking from the smaller-volume carton without a straw, which is the manner of drinking preferred by youths and young adults.

As a partial solution to this problem, portion packages have been provided which have a larger pre-punched hole of such a size as to permit direct drinking from the carton, and a pull-tab device covering the large pre-punched hole. In this way, a consumer simply removes the large pull-tab in order to drink directly from the carton. However, if one does not desire to consume all of the contents, the package cannot be resealed and is susceptible to spillage. Furthermore, in some countries, consumers strongly dislike having to touch the laminated packaging material with the lips.

Many opening devices are known which have means of cutting through a portion of a carton, such as the aseptic barrier layer, during opening.

Laid-open Japanese Patent No. 63-149818 describes an opening device having a frame bearing two upright semi-circular walls. A lever having a matching semi-circular configuration is journalled between the walls for rotation about an axis passing substantially through the centers of the planar bases of the semi-circular walls, parallel and adjacent to the surface of the package. The lower portion of the lever facing the package has teeth for rupturing the packaging material, and a grip-tab, whereby a user can open the package by rotating the lever in one direction, and reclose the package by rotating the lever in the opposite direction. However, this kind of opening device is not suitable for direct drinking from the package and requires the application of significant force in order to drive the teeth through the packaging material. This may lead to inadvertent spillage of the contents of the package.

Laid-open Japanese Patent Application No. 64-2727 describes an opening device having a frame defining a tubular portion, a sleeve arranged slideably within the tubular portion and connected to the frame by a collapsible bellows, and a cap hinged to the frame and overlying the open uppermost end of the sleeve in a closed position. A user has to apply pressure on the cap, which is transferred to the sleeve, thereby collapsing the bellows. The lower end of the sleeve punctures the packaging material of the container and the reclosable cap can be opened to pour the contents. However, the cap can be knocked during handling and transportation, thereby inadvertently collapsing the bellows and causing the sleeve to puncture the underlying packaging material.

Also known from laid-open Japanese Patent Application No. 63-156928 is a three-piece opening device consisting of a frame having an externally threaded portion, a screw-cap which can be screwed onto the frame, and a sleeve located in a tubular portion of the frame and having a lower toothed edge which, when actuated by screwing the cap onto the frame, perforates the laminated packaging material of a container.

However, in all of these latter-mentioned devices provided with means for cutting through packaging material when opening a carton, there is the drawback that the contents of the package may be accessed by a user when the cutting of the packaging material is incomplete. This means that there may be an insufficient opening to provide for correct pouring of the product from the carton. This drawback is especially serious when drinking directly from the carton, because if the product does not pour in a sufficient quantity, a user may be tempted to squeeze the carton, causing an increase in pressure in its interior. If the increased pressure suddenly ruptures the partly-cut packaging material, the product would gush out of the carton, with obvious inconveniences for the consumer.

OBJECTS OF THE INVENTION

Accordingly, a main aim of the invention is to provide a new type of device for opening packages of pourable food products which overcomes the drawbacks encountered in the prior art opening devices.

Within this aim, an object of the invention is to provide a device for opening packages of pourable food product, especially for portion packs, which prevents opening of the package until an aseptic barrier layer in a pre-punched hole has been completely ruptured, so as to guarantee correct pouring once the package has been opened.

Another object of the invention is to provide a device for opening packages of pourable food product, which permits direct drinking from small cartons or portion packages, without a consumers lips contacting the laminated packaging material surrounding the device.

A further object of the invention is to provide a device for opening packages of pourable food product which, once applied to a carton and actuated to cut through the packaging material constituting the carton, cannot be returned to its original state, whereby to provide extremely visible tamper evidence for the consumer.

Another object of the invention is to provide a device for opening packages of pourable food product which can be quickly and easily re-closed, and which is completely reliable and safe in use.

DISCLOSURE OF THE INVENTION

With the above aim and objects in view, the invention provides a device for opening packages of pourable food product comprising a frame fixable on a package, a tubular member connected to said frame and internally defining a pouring opening, and a cap pivotally connected to said tubular member for rotation about a first axis for opening and closing said pouring opening, characterized in that said tubular member is movably connected to said frame for rotation about a second axis extending substantially perpendicularly with respect to said first axis. Further features of the invention are defined in the sub-claims.

According to another aspect of the present invention, there is also provided a package of pourable food product, characterized in that it comprises an opening device as defined in claims 1–9.

BRIEF DESCRIPTION OF THE DRAWING FIGURES

Further features and advantages of the device for opening packages of pourable food product, according to the invention, will become apparent from the following detailed description of a preferred embodiment thereof, and from the attached accompanying drawing figures wherein.

DESCRIPTION OF THE PREFERRED EMBODIMENT

Figure 10:
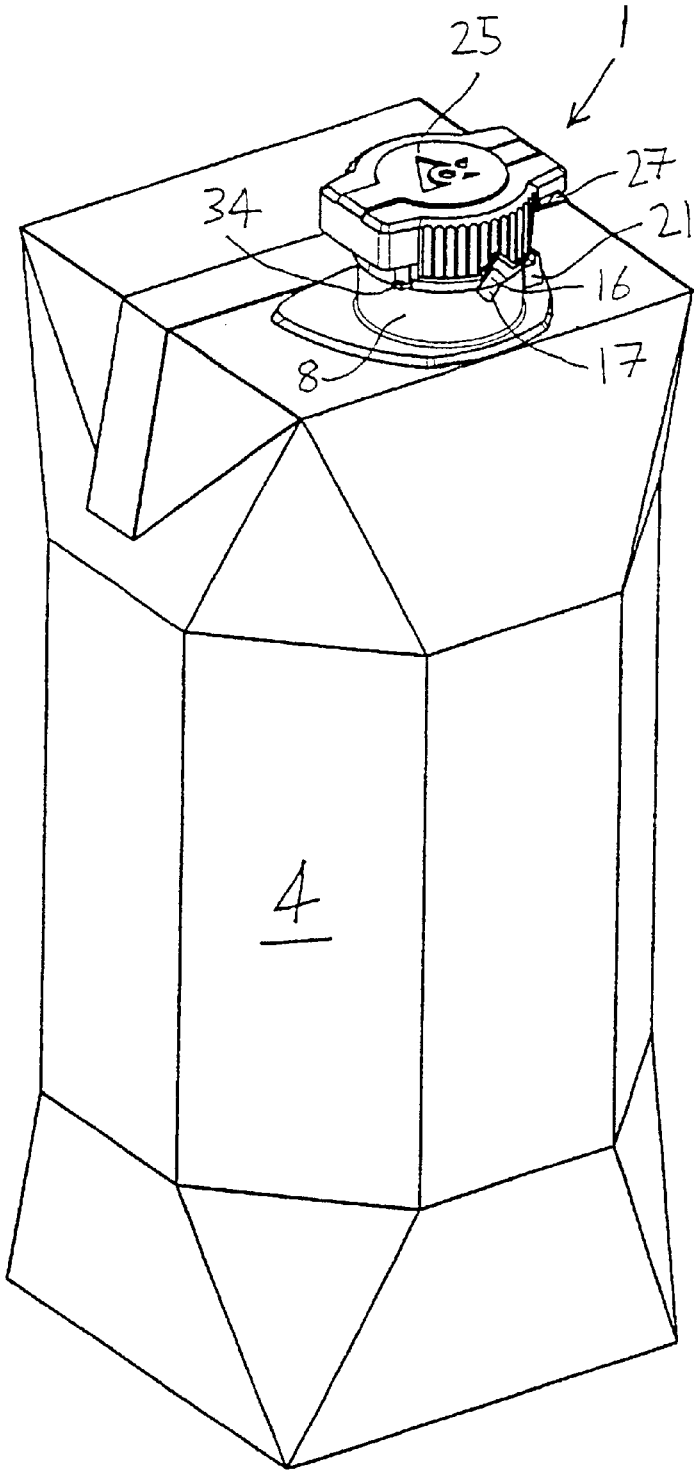
FIG. 10 is a perspective view of a package provided with a device for opening packages of pourable food product according to the invention.

With reference to the above-described drawing figures, the reference numeral 1 generally indicates the device for opening packages of pourable food product according to the invention. The device 1 has a frame 2 provided with a flange 3, which can be affixed to a package 4. FIG. 10 illustrates the opening device 1 with the flange 3 of the frame 2 fixed to a package which, in the illustrated example, has a substantially parallelepiped configuration with beveled corners. The fixing of the frame to the package 4 may be achieved with any conventional fixing means available to one skilled in the art such as e.g., by hot-melt adhesive, microflame welding, or laser welding. The frame is advantageously provided with a flat upper surface 5, structurally reinforced by a plurality of ribs 6, provided on the lower surface of the frame which is destined to be affixed to a package and thus hidden from view. This arrangement provides adequate strength while minimizing the overall quantity of plastics material employed for manufacture of the device.

The frame 2 defines an annular sleeve 7, composed of a lower portion 8 and an upper portion 9. The lower portion of the annular sleeve protrudes upwardly from the upper surface 5 of the frame and has internal threads 10 formed on its inner surface, and at least one ratchet tooth 11, provided adjacent the threads 10. The upper portion 9 is arranged concentrically with respect to the lower portion and has a slightly greater diameter than the lower portion. More specifically, the inner diameter of the upper portion 9 is slightly greater than the outer diameter of the lower portion 8, and the upper edge 12 of the lower portion is connected to the lower edge 13 of the upper portion by rupturable connection means 14, which preferably comprise a plurality of rupturable bridges 14*a,* 14*b,* 14*c,* 14*d,* 14*e* and 14*f*. The upper portion 9 of the annular sleeve has a slot 15 formed therein, and both the upper and lower portions preferably have formed thereon aligned indicia 16, 17 for indicating the relative position of the upper portion with respect to the lower portion of the annular sleeve, in an intact condition of the device, thereby providing a tamper evidence for the consumer. The frame 2 also has an arc-shaped wall 18, which is spaced from and partly circumscribes the lower portion 8 of the annular sleeve 7, and has a height which is slightly less than that defined by the lower portion 8. A retaining protuberance 19 protrudes radially inwardly from the uppermost edge of the arc-shaped wall 18 towards the lower portion 8, and a gap 20 is defined between the retaining protuberance 19, and the lower portion 8. A block or index element 21 is also provided on the frame adjacent an end 18*a* of the arc-shaped wall 18.

The device also has a tubular member 22, which has external threads 23 formed thereon for screw thread engagement with the threads 10 provided on the internal surface of the lower portion 8 of the threaded annular sleeve 7, and internally defines a pouring opening 24 extending co-axially with respect to the annular sleeve. A cap 25 having an inner sealing rim 26, is pivotally connected to the tubular member 22 by means of a conventional elastic hinge 27, for rotation about a first axis 28. The cap is rotatable through substantially 180 degrees about the first axis for opening and closing the pouring opening. The cap 25 closes on the tubular member in a snap-together manner, with the rim 26 sealingly engaging an upper sealing edge 29 of the tubular member 22. The external threads 23 engage the threads 10 to movably connect the tubular member 22 to the frame 2 for rotation about a second axis 30, which extends perpendicularly with respect to the first axis 28.

Figure 1:
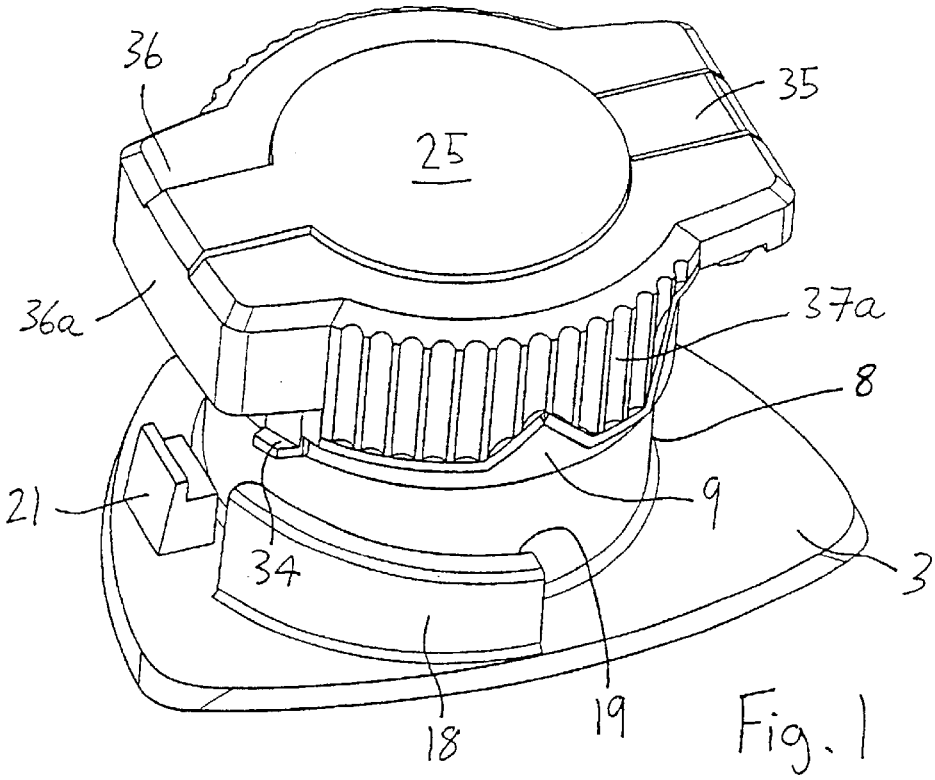
FIG. 1 is a top perspective view of the device for opening packages of pourable food product according to the invention, viewed from one side thereof, shown in a closed condition.
Figure 2:
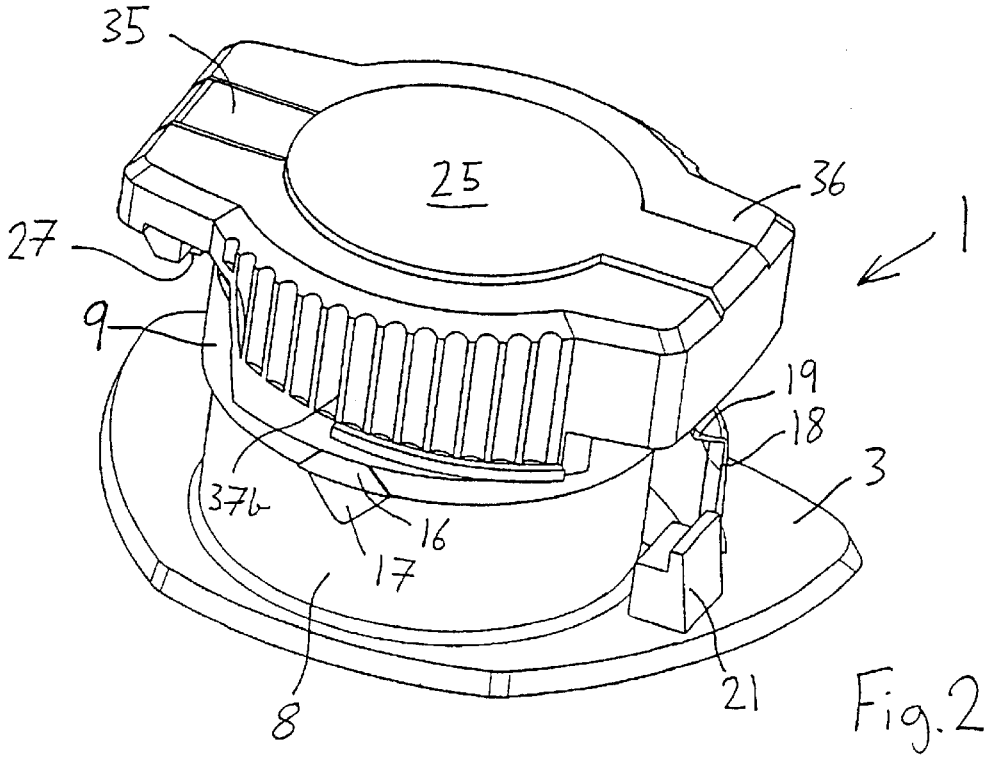
FIG. 2 is a top perspective view of the device of FIG. 1, viewed from an opposite side thereof.
Figure 3:
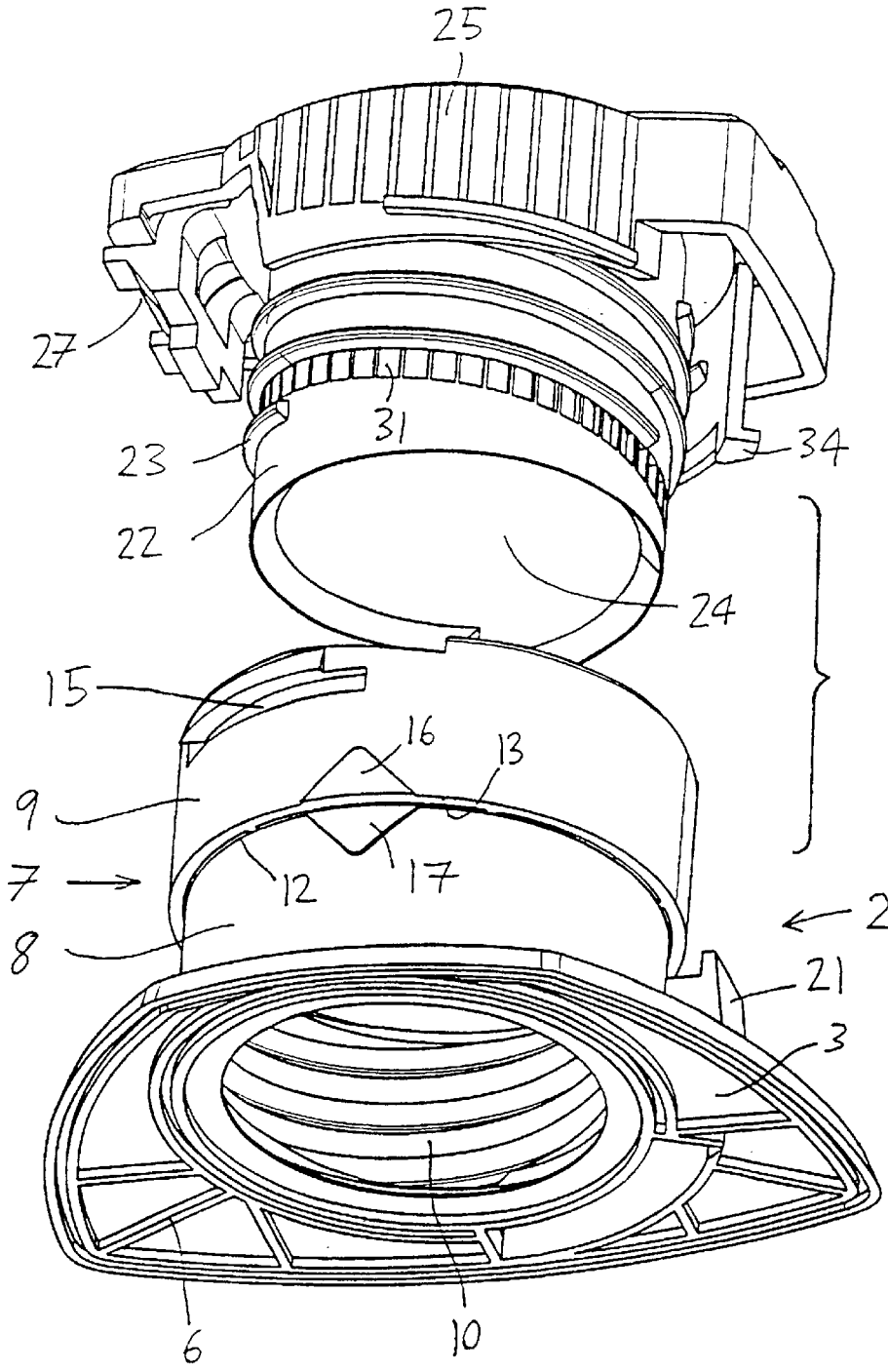
FIG. 3 is an exploded bottom perspective view of the device for opening packages of pourable food product of FIG. 2, shown to a smaller scale.
Figure 4:
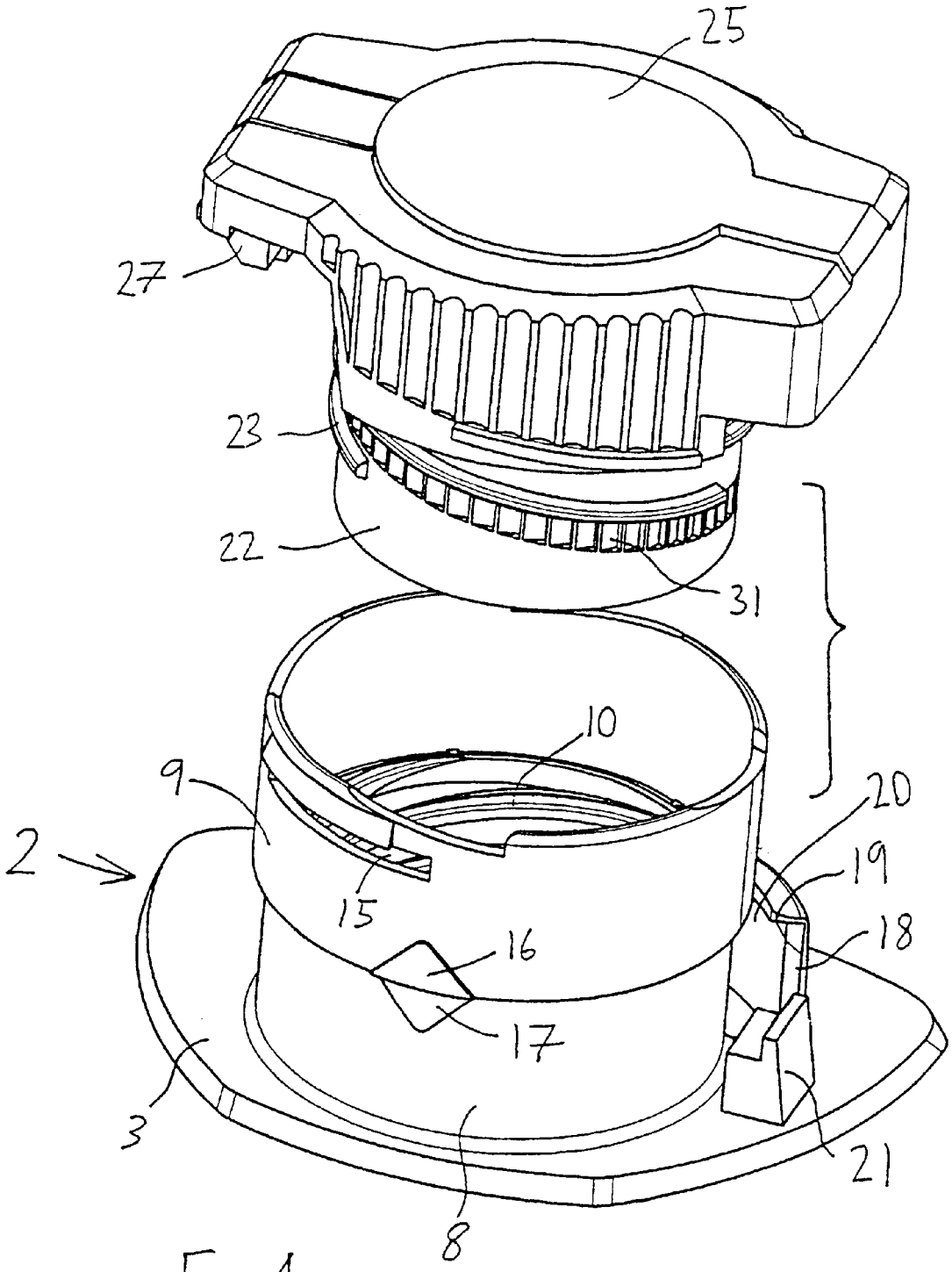
FIG. 4 is an exploded top perspective view of the device of FIG. 3.
Figure 5:
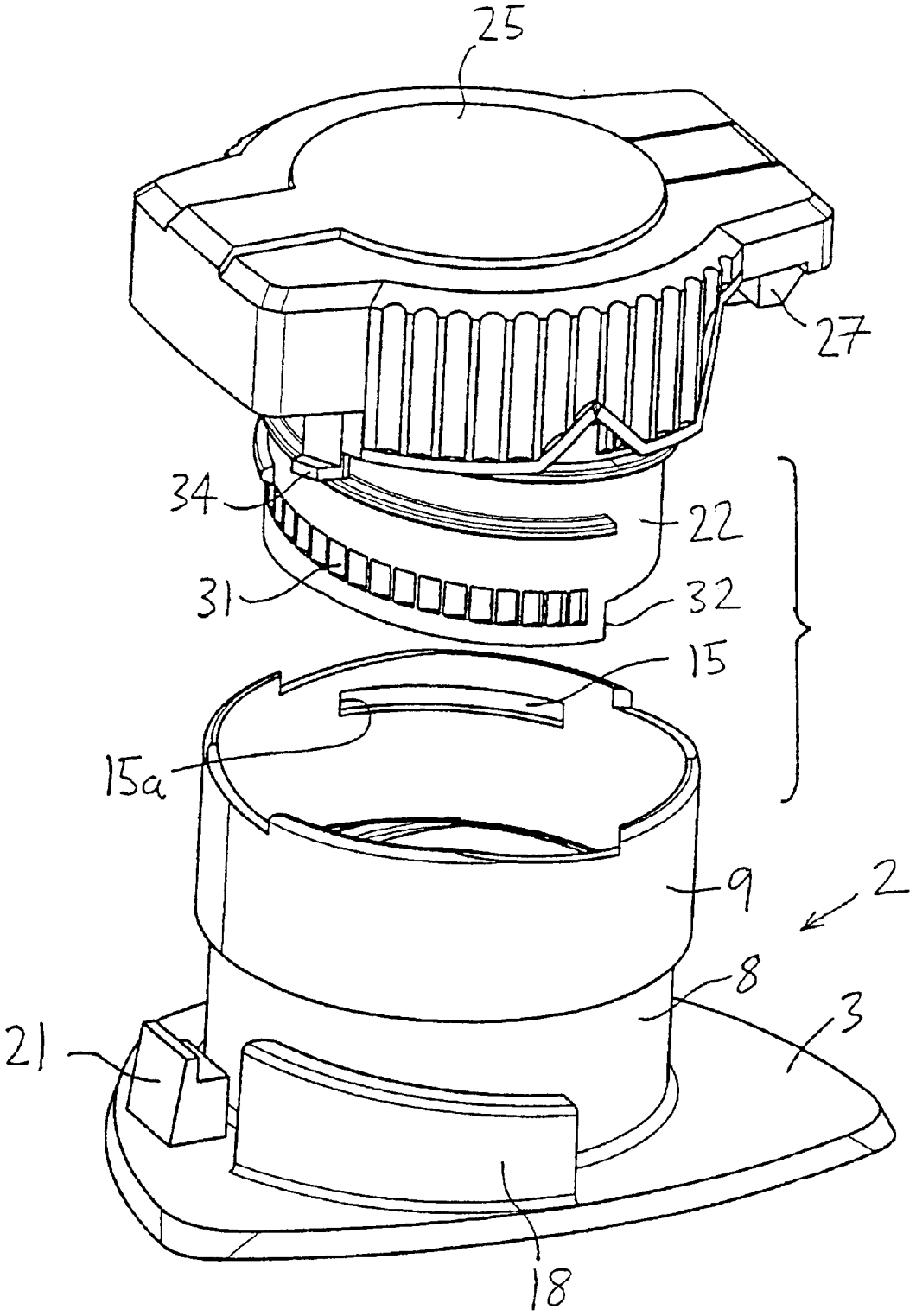
FIG. 5 is an exploded top perspective view of the device of FIG. 1.
Figure 6:
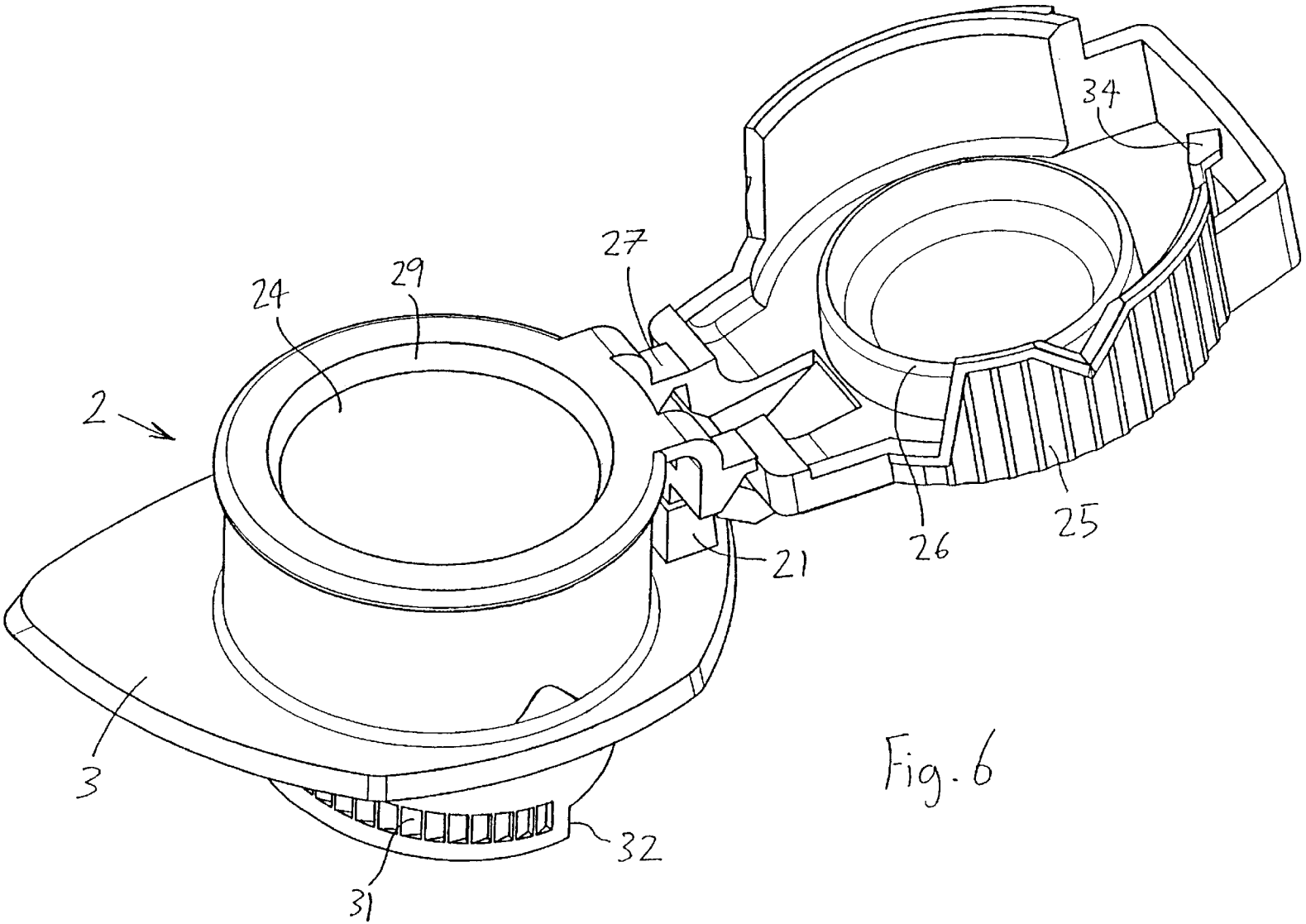
FIG. 6 is an enlarged-scale top perspective view of the device for opening packages of pourable food product shown in FIGS. 1–5, viewed from one side thereof, and shown in an opened condition.
Figure 7:
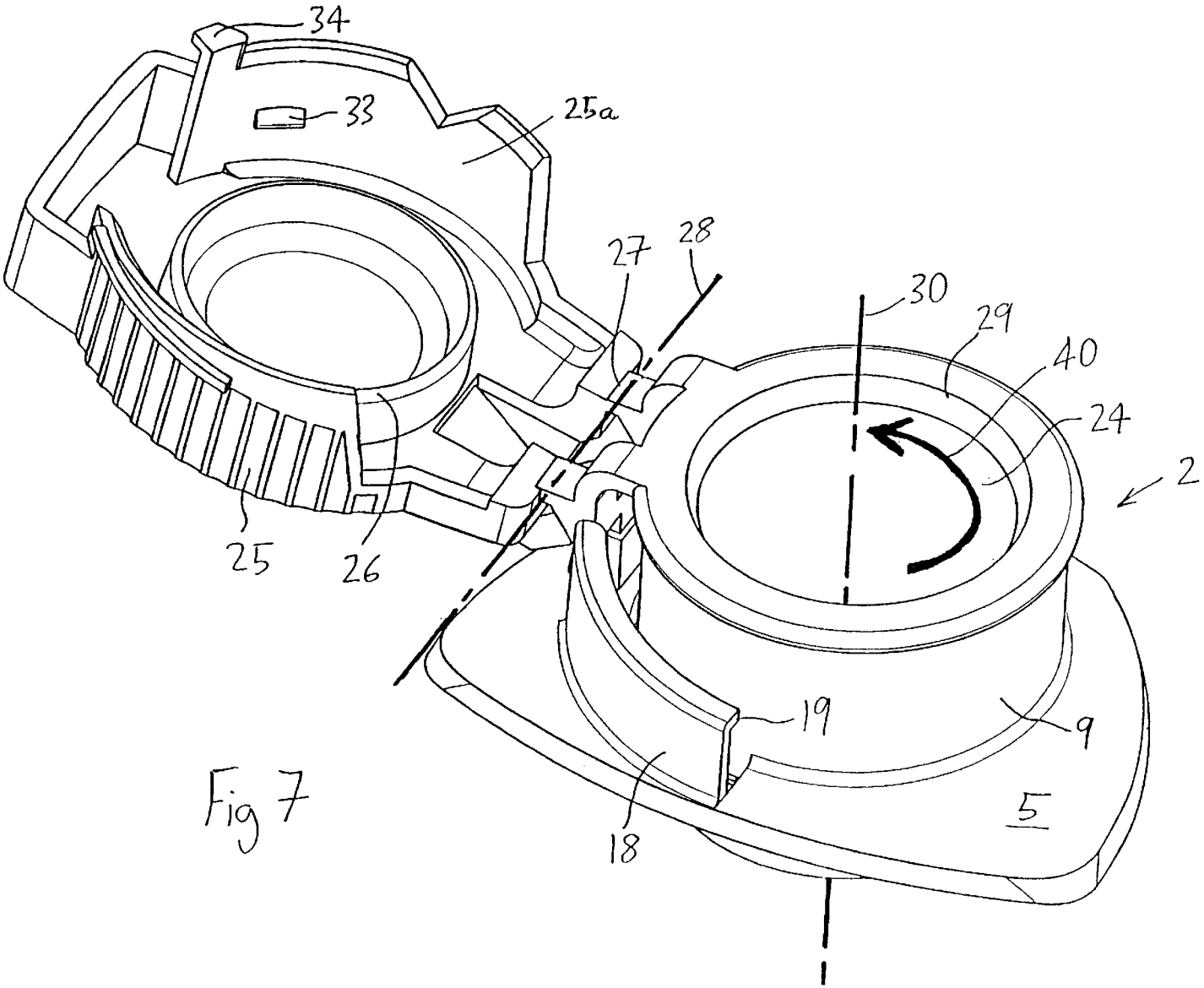
FIG. 7 is a top perspective view of the device of FIG. 6 as viewed from an opposite side thereof.

A plurality of indentations 31 is provided on the outer surface of the tubular member for unidirectional movement over the ratchet pawl 11, provided in the lower portion 8 of the annular sleeve 7. The indentations are configured in a saw-tooth manner, such that they can easily slide over the ratchet pawl 11 in one direction when the tubular member 22 is rotated in the direction of the arrow 40, but any reverse movement of the tubular member is prevented, whereby to prevent any possibility of returning the cap and the tubular member to its original position, once it has been operated or tampered with. Cutting means, constituted by at least one cutting tooth 32, are defined on the lowermost edge of the tubular member for penetrating a portion of a package 4 underlying the pouring opening 24 upon movement of the tubular member 22 with respect to the frame 2 about the second axis 30 in the direction of the arrow 40. Preferably, the cutter and the threaded members are arranged in such a manner as to enable the cutter to cut completely through the packaging material and ensure insertion of the tubular member 22 into the hole in the packaging material, upon rotating the cap and the tubular member with respect to the frame, substantially through 180 degrees. In this manner, a user simply has to grip the cap and rotate the tubular member through 180 degrees about the second axis 30, in the illustrated example, in an anti-clockwise direction as indicated by the arrow 40 in FIG. 7, and then rotate the cap through approximately 180 degrees about the mutually perpendicular first axis 28, in order to enable product to be poured through the pouring opening 24.

Means are also provided for rotationally engaging the cap 25 and the upper portion 9 of the annular sleeve 7, and include at least one lug 33 connected to an inner surface 25*a* of the cap 25. The lug 33 slideably engages the above-mentioned slot 15 provided on the upper portion 9 during rotation of the cap 25. When the lug 33 abuts the end 15*a* of the slot 15, torsional force applied to the cap 25 is transmitted to the rupturable connection bridges 14*a*–14*f,* in order to break the rupturable connection bridges 14*a*–14*f*. In practice, once the bridges 14*a*–14*f* are broken, the upper portion 9 is free to slide downwardly over the lower portion 8 of the annular sleeve 7, during rotation of the cap 25 cap with respect to the frame 2.

In accordance with the invention, the device for opening packages of pourable food products also has means for preventing rotation of the cap 25 about the first axis 28, during rotation of the tubular member 22 about the second axis 30, until completion of a predetermined angular displacement of the tubular member 22 with respect to the frame 2. The latter-mentioned means are preferably constituted by the above-mentioned arc-shaped wall 18 connected to the frame 2, the protuberance 19 protruding radially inwardly from the upper portion of the arc-shaped wall 18, and at least one tab 34 connected to the cap 25 and slidingly engaging the protuberance. The tab 34 protrudes radially outwardly from the cap 25 and is located beneath the protuberance during rotation of the cap 25 with respect to the frame 2. In this manner, the cap 25 cannot be opened until it has been rotated to such an extent that the tab 34 exits from beneath the protuberance, i.e., when the packaging material has been perforated by the cutter 32 and the tubular member 22 is inserted into the perforation.

For completeness of description, as can be seen in the drawing figures, in the embodiment of the invention illustrated in the drawings, the cap 25 preferably has a protruding lug 35 which covers the elastic hinge 27, and a protruding tab 36, located diametrically opposite the protruding lug and preferably having a flat end portion 36*a,* adapted to be lifted by a user in order to rotate the cap 25 about the hinge 27. Advantageously, two knurled or ribbed portions 37*a,*37*b* extend between the protruding lug and the protruding tab at diametrically opposite sides of the cap 25. FIG. 10 illustrates a package for pourable food products provided with a device 1 according to the invention. Although FIG. 10 illustrates a carton of the type having a substantially parallelepiped configuration with bevelled corners, it will be understood that the device can be used on cartons of any shape, such as parallepiped cartons with straight corners, tetrahedral cartons, etc.

The operation of the device for opening packages of pourable food products according to the invention will now be described:

With reference to FIG. 10, it can be seen that the on the package 4 provided with the device according to the invention, the flat end portion 36*a* is located adjacent to the index element 21, and the indicia 16, 17 are aligned, thereby providing a clear indication of the integrity of the package. In order to open the package, a user grips the ribbed portions 37*a*,37*b* and starts to rotate the cap 25 in an anti-clockwise direction indicated by the arrow 40. The external threads 23 of the tubular member engage the matching internal threads 10 in the lower portion 8 of the annular sleeve 7. During rotation of the cap, the lug 33 slides along the slot 15, and when the lug 33 abuts the end 15*a* of the slot 15, the torsional force applied to the cap is transmitted to the rupturable connection bridges through the upper portion 9 if the annular sleeve 7. This causes breakage of the connection bridges 14*a*–14*f*, and the upper portion 9 of the annular sleeve 7 starts moving downwardly over the lower portion 8 thereof, due to the combined axial downward movement and rotational movement of the cap 25 and the tubular member 22.

Figure 8:
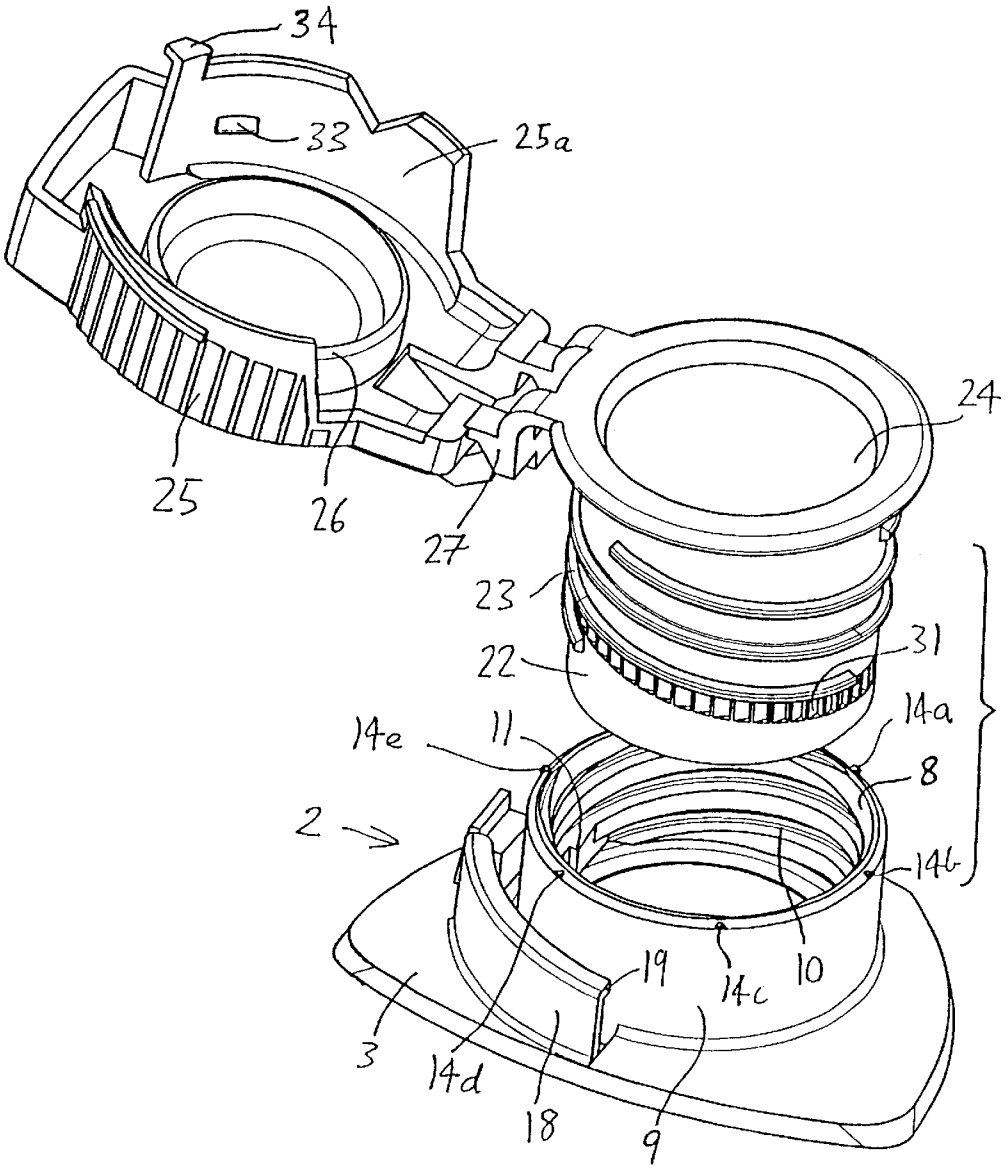
FIG. 8 is an exploded top perspective view of the device of FIG. 7.
Figure 9:
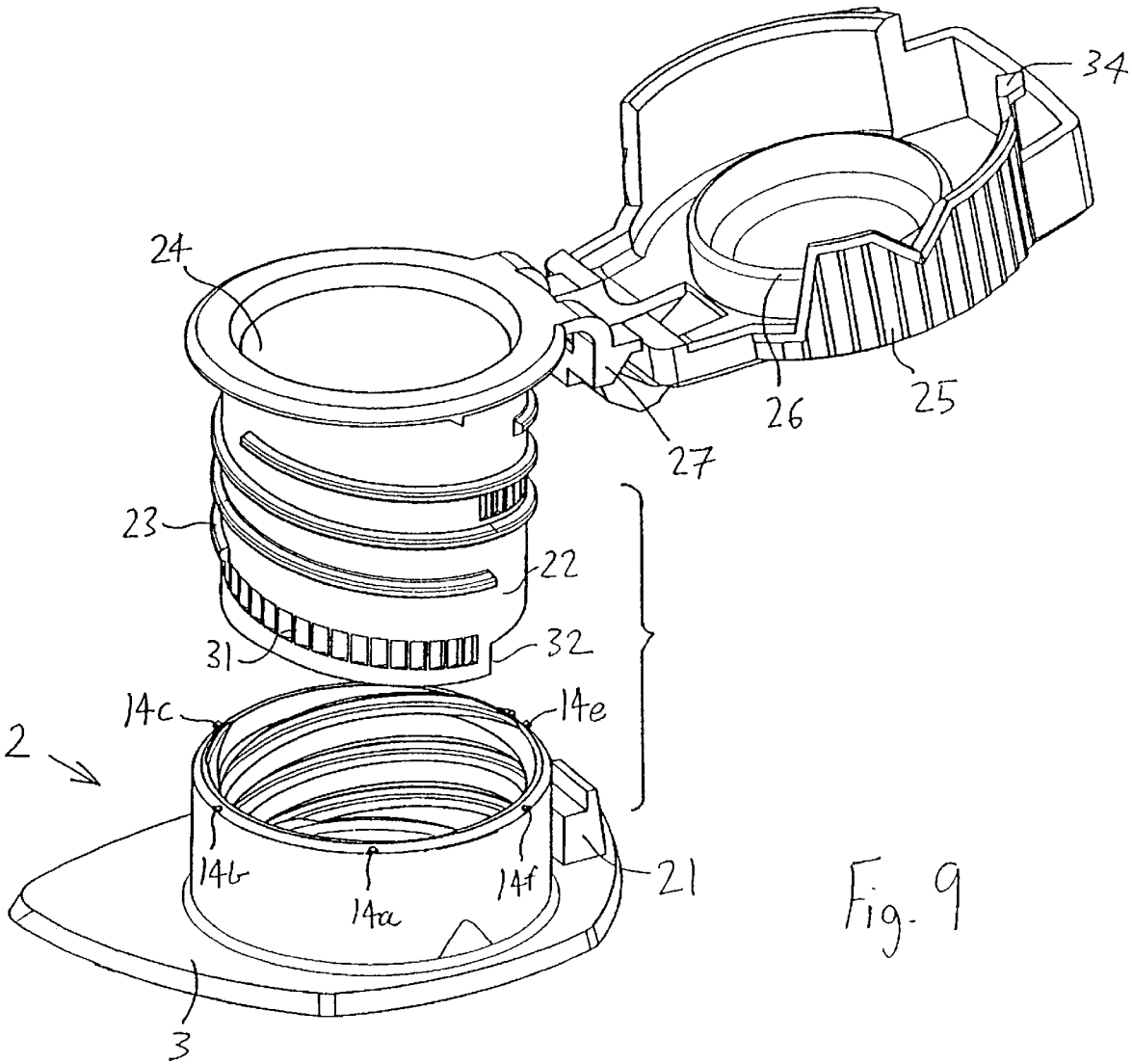
FIG. 9 is an exploded top perspective view of the device of FIG. 6.

At this point, the flat end portion 36*a* is moved away from the index element 21, and the indicia 16, 17 become misaligned, thereby providing a clear indication that the device has been operated. The indentations 31 move unidirectionally over the ratchet pawl 11 (see FIG. 8) and prevent any return movement of the cap and the tubular element. Since any tampering with the opening devices is clearly indicated, and since the cap and the tubular member cannot be rotated in a reverse direction, any packages which have been tampered with can be immediately seen by a consumer or store personnel.

Continued rotation of the cap about the second axis 30 causes the cap to move downwardly during its rotation, the tab 34 passes beneath the protuberance 19 of the arc-shaped wall, and the cutter 32 starts to cut the underlying packaging material. Not only is reverse rotational movement of the tubular member 22 prevented by the engagement of the indentations with the ratchet pawl 11, but also the cap 25 is prevented from rotating about the first axis 28 defined by the elastic hinge 27. To this end, the tab 34 remains slideably engaged beneath the protuberance 19, for a predetermined angular displacement of the tubular member 22 with respect to the frame 2, determined by the length of the arc-shaped wall 18, which is calculated so as to ensure that opening of the cap 25 is prevented until the cutter 32 has completely perforated the underlying packaging material and the tubular member 22 is inserted into the thus-formed perforation. Only thereafter, when the cap 25 has been rotated through substantially 180 degrees and the tab 34 exits from beneath the protuberance 19, can the cap 25 be opened to enable a consumer to pour the contents of the package through the pouring opening 24.

In a fully opened condition of the package, the cap 25 has been rotated through approximately 180 degrees about the first axis 28, the tubular member has been rotated through approximately 180 degrees about the second axis 30, the upper portion 9 of the annular sleeve 7 has slid downwardly over the lower portion 8 thereof, the tubular member and the cutter 32 protrude below the flange 3 of the frame 2, and the elastic hinge 27 is located adjacent to the index element 21.

The above-described embodiment exemplifies one structural arrangement of the device for opening packages of pourable food product according to the invention, which fully meets the above-mentioned aim and objects of the invention. In particular, a new device has been provided which enables direct drinking from a package of pourable food product, such as tea, fruit-juice etc, without the drawbacks encountered in the known devices. The device according to the invention prevents opening of the package until an aseptic barrier layer in a pre-punched hole has been completely ruptured, so as to guarantee correct pouring once the package has been opened. Furthermore, once the device has been applied to a carton and actuated to cut through the packaging material constituting the carton, it cannot be returned to its original state, thereby providing an extremely visible tamper evidence for the consumer. The device is also very practical in that it can be quickly and easily re-closed and is completely reliable and safe in use. Moreover, it will be noted that the annular sleeve 7 may be inclined, i.e., arranged at an acute angle, with respect to the top of the package 4, to facilitate cutting of the packaging material with the cutting means 32.

The invention as set forth herein is susceptible to modifications, without thereby departing from the purview of the appended claims.

What is claimed is:

1. A device for opening packages of pourable food product, comprising:

a frame fixable on a package;

a tubular member connected to said frame and internally defining a pouring opening;

a cap pivotally connected to said tubular member for rotation about a first axis for opening and closing said pouring opening, said tubular member being movably connected to said frame for rotation about a second axis extending substantially perpendicularly with respect to said first axis; and means for preventing rotation of said cap about said first axis, during rotation of said tubular member about said second axis, until completion of a predetermined angular displacement of said tubular member with respect to said frame.

2. The device for opening packages of pourable food product according to claim 1, wherein said means for preventing rotation of said cap about said first axis, during rotation of said tubular member about said second axis, until completion of a predetermined angular displacement of said tubular member with frame, and a tab connected to said cap and slidingly engaging said protuberance.

3. The device for opening packages of pourable food product according to claim 2, wherein:

an arc-shaped wall connected to said frame and partially circumscribing a threaded annular sleeve provided on said frame, said protuberance protruding radially inwardly from an upper portion of said arc-shaped wall, said tab protruding radially outwardly from said cap and being locatable beneath said protuberance during rotation of said cap with respect to said frame.

4. The device for opening packages of pourable food product according to claim 1 further comprising:

means for preventing unscrewing of said tubular member from a threaded annular sleeve provided on said frame, said means including at least one ratchet pawl provided in said annular sleeve, and a plurality of indentations formed on said tubular member and adapted for unidirectional movement over said ratchet pawl.

5. The device for opening packages of pourable food product according to claim 1, wherein:

said frame has a threaded annular sleeve, said tubular member having threads engaging said threaded annular sleeve and cutting means defined thereon for penetrating a portion of a package underlying said pouring opening upon movement of said tubular member with respect to said frame about said second axis, said second axis corresponding to a longitudinal mid-axis of said tubular member and said annular sleeve;

said annular sleeve comprises a lower portion fixed to said frame, and an upper portion having a greater diameter than said lower portion and connected thereto by rupturable connection means.

6. The device for opening packages of pourable food product according to claim 5, further comprising:

means for rotationally engaging said cap and said upper portion of said annular sleeve during rotation of said cap with respect to said frame, for breaking said rupturable connection means.

7. The device for opening packages of pourable food product according to claim 5, wherein said means for rotationally engaging said cap and said upper portion comprise at least one lug connected to an inner surface of said cap, and at least one slot provided in said upper portion, said lug engaging said slot during rotation of said cap for transmitting force applied to said cap to break said rupturable connection means during rotation of said cap, said upper portion circumscribing and sliding downwardly over said lower portion during rotation of said cap with respect to said frame.

8. A package containing a pourable food product including a device for opening the package, comprising:

a frame fixable on the package;

a tubular member connected to said frame and internally defining a pouring opening; and a cap pivotally connected to said tubular member for rotation about a first axis for opening and closing said pouring opening, said tubular member being movably connected to said frame for rotation about a second axis extending substantially perpendicularly with respect to said first axis; and means for preventing rotation of said cap about said first axis, during rotation of said tubular member about said second axis, until completion of a predetermined angular displacement of said tubular member with respect to said frame.

9. A package containing pourable food product including a device for opening the package, comprising:

a frame fixable on the package;

a tubular member connected to said frame and internally defining a pouring opening; and a cap pivotally connected to said tubular member for rotation about a first axis for opening and closing said pouring opening, said tubular member being movably connected to said frame for rotation about a second axis extending substantially perpendicularly with respect to said first axis; and means for preventing rotation of said cap about said first axis, during rotation of said tubular member about said second axis, until completion of a predetermined angular displacement of said tubular member with respect to said frame said frame having an annular sleeve, wherein said annular sleeve is inclined with respect to the top of said package, whereby to facilitate cutting of packaging material constituting said package with cutting means disposed on said tubular member.

* * * * *